United States Patent [19]

Bettschen

[11] Patent Number: 4,558,956

[45] Date of Patent: Dec. 17, 1985

[54] WATER-TIGHT WATCH

[75] Inventor: Josef Bettschen, Niederwil, Switzerland

[73] Assignee: Mondaine Watch Ltd., Switzerland

[21] Appl. No.: 675,843

[22] Filed: Nov. 28, 1984

[30] Foreign Application Priority Data

Dec. 20, 1983 [CH] Switzerland ..... 6771/83

[51] Int. Cl.[4] ..... G04B 37/00

[52] U.S. Cl. ..... 368/291; 368/292; 368/294

[58] Field of Search ..... 368/291, 292, 294–296, 368/300, 309, 286

[56] References Cited

U.S. PATENT DOCUMENTS 4,198,811 4/1980 Ratajski ..... 368/294

FOREIGN PATENT DOCUMENTS 2476340 8/1981 France ..... 368/286
524141 4/1955 Italy ..... 368/296
480679 12/1969 Switzerland ..... 368/291
632374 10/1982 Switzerland ..... 368/309

*Primary Examiner*—Bernard Roskoski
*Attorney, Agent, or Firm*—Kane, Dalsimer, Kane, Sullivan and Kurucz

[57] ABSTRACT

The watch has at the top edge of its case, on opposite sides, flanges which project radially inwards and the underside of which is at a distance from the watch-glass edge. To close the watch and press the watch glass against a packing resting on an inner case shoulder, there are two shackle-shaped clamping slides which each have two legs and which can be pushed from the two opposite flange-free case sides into the slits located between each of the flanges and the watch-glass edge. When the clamping slides are pushed in, the packing is compressed strongly enough by the watch glass pressing against it, in order to achieve perfect water-tightness. The invention relates in particular to a watch which has a molded case produced from plastic and or rectangular or even oval shape.

17 Claims, 11 Drawing Figures

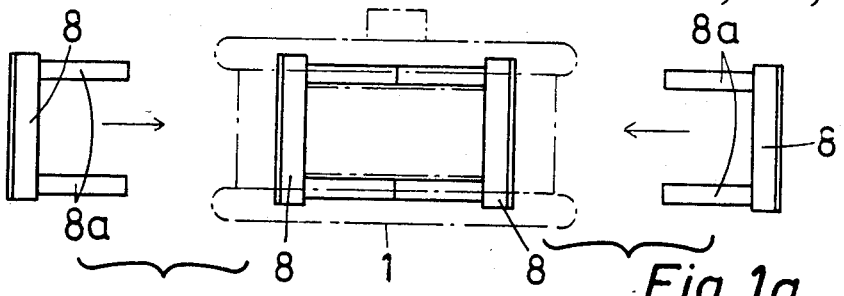
Fig. 1a
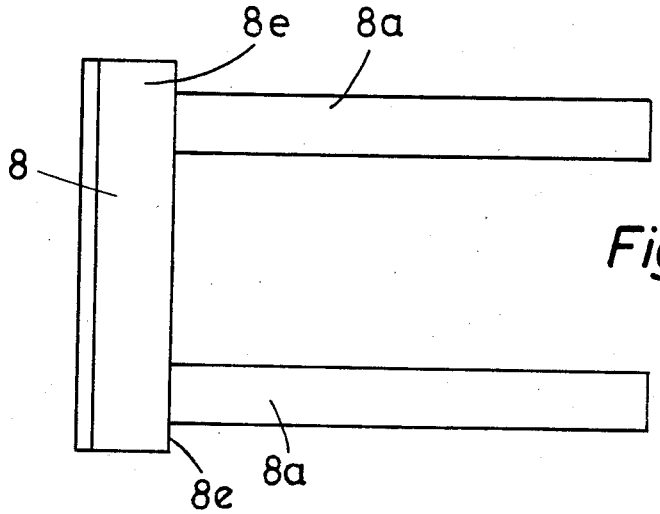
Fig. 4
Fig. 5
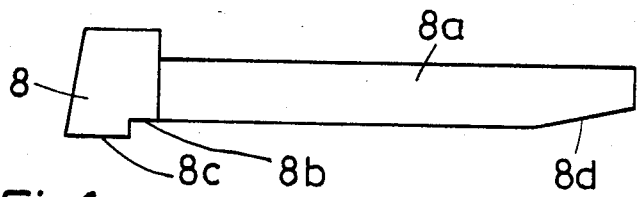
Fig. 1
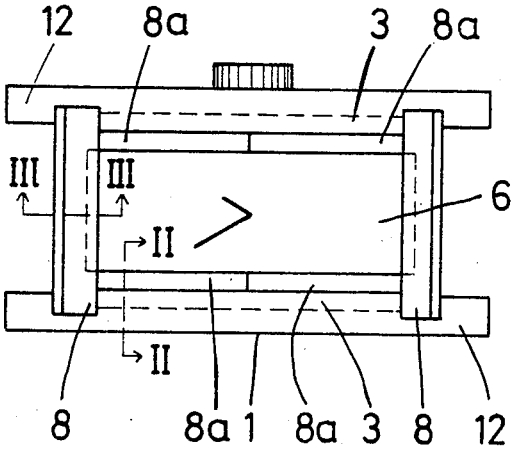

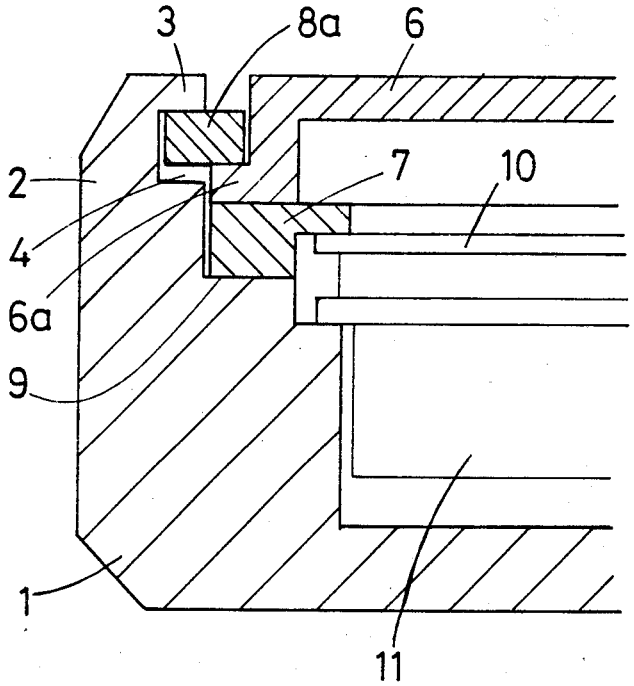
Fig. 2
Fig. 3
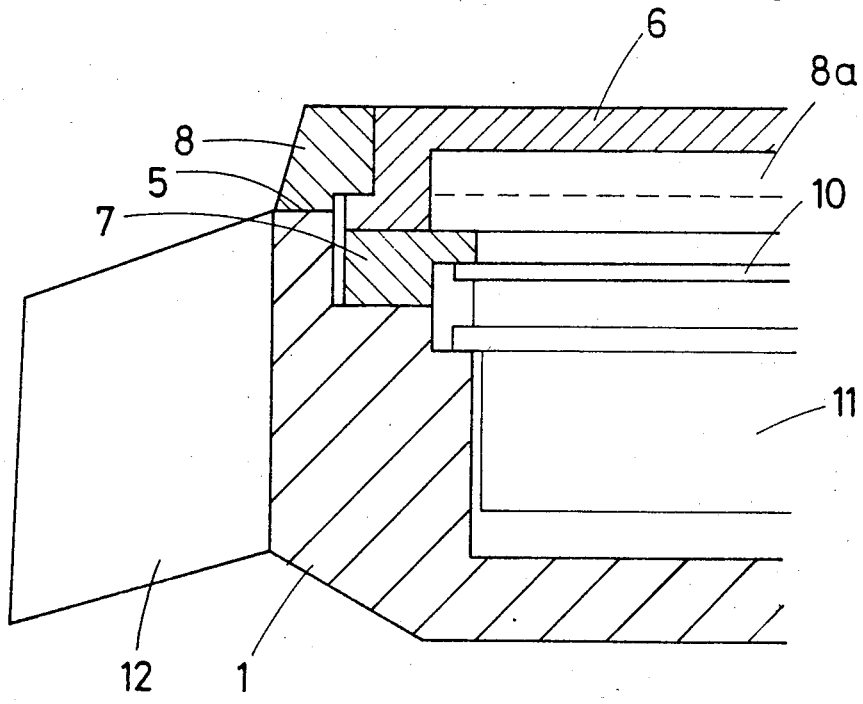

WATER-TIGHT WATCH

FIELD OF INVENTION

The invention relates to a water-tight watch with a packing gripped between the watch glass and an inner shoulder of the case.

PRIOR ART

In known watches of this type, the watch glass is generally retained by a bezel which has to press the watch-glass edge against the inner case shoulder with sufficient force to ensure that, to achieve perfect water-tightness, the packing is compressed sufficiently strongly and uniformly. For this purpose, it has been necessary, hitherto, to attach to the watch parts to be fastened to one another accurately dimensioned fitting elements, one of which has to be slightly elastic for snapping in, so that the element to be fitted in can be introduced under pressure into the corresponding recess. The narrow tolerances which exist between the parts to be connected to one another and which have been necessary hitherto for the perfect closure of a watch make production and, under certain circumstances, also assembly more complicated and more expensive.

In particular, the problem of making a molded case produced from plastic, for example a rectangular case, completely water-tight has not yet been solved satisfactorily, since plastic cases generally made as an injection molding do not have the necessary narrow tolerances and would first have to be remachined, this being time-consuming and costly.

The object on which the invention is based is to simplify and organize the production and assembly of a water-tight watch, especially with a rectangular molded case consisting of plastic, in such a way that reliable compression of the packing and consequently perfect water-tightness are achieved without special outlay, and at the same time exact tolerances of the interacting parts are not important.

SUMMARY OF THE INVENTION

According to the invention, this object is achieved by means of the features indicated in the characterising clause of patent claim 1.

The measure according to the invention is used to advantage in a molded case consisting of plastic, especially a rectangular case. Because the clamping slides consisting of plastic or metal are pushed in a simple way in the manner of a drawer into the slits underneath the case flanges projecting radially inwards, the axial force necessary for the perfect and uniform compression of the packing is obtained in a simple way and the case thus closed hermetically. To open the watch, it is merely necessary to pull the clamping slides out again laterally.

Furthermore, since the legs of the clamping slides can easily be made elastically flexible, the invention also relates, in principle, to oval watches and generally to watch cases which have an opposite sides upper edge portions curved in any form. When the clamping slides are pushed in, the elastically flexible legs, which, if appropriate, can already have a curvature corresponding approximately to the curved form of the respective edge portions, then match the form of the slits and consequently the respective edge portions.

Two clamping slides which can be pushed in from opposite sides, especially from the strap-connection sides, are preferably provided.

Appropriate designs of a watch according to the invention emerge from the dependent claims.

BRIEF DESCRIPTION OF THE DRAWINGS

The invention is explained in more detail by means of three exemplary embodiments with reference to the drawings in which:

FIG. 1 shows a plan view of a first embodiment of a wrist-watch according to the invention, FIG. 1*a* shows a diagrammatic representation which illustrates how the clamping slides are pushed in and their position in the ready-assembled watch, the remaining parts of which are indicated merely by dot-and-dash lines, FIG. 2 shows a part section along the line II—II according to FIG. 1 in an enlarged representation, FIG. 3 shows a part section along the line III—III according to FIG. 1, likewise in an enlarged representation, FIG. 4 shows a plan view of a clamping slide, FIG. 5 shows a side view of the clamping slide according to FIG. 4.

DESCRIPTION OF THE PREFERRED EMBODIMENTS

Figure 6:
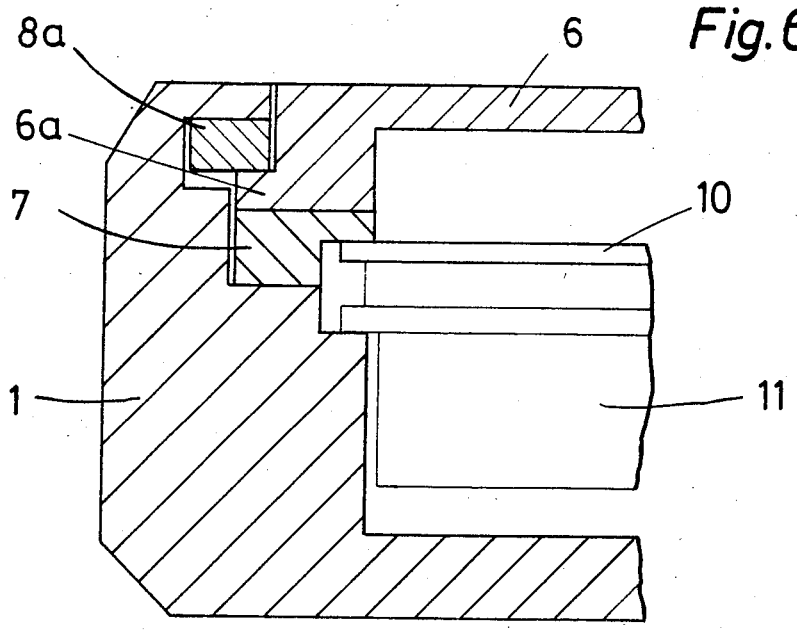
FIG. 6 shows a part section, corresponding to the representation according to FIG. 2, of a second embodiment of a wrist-watch according to the invention.
Figure 8:
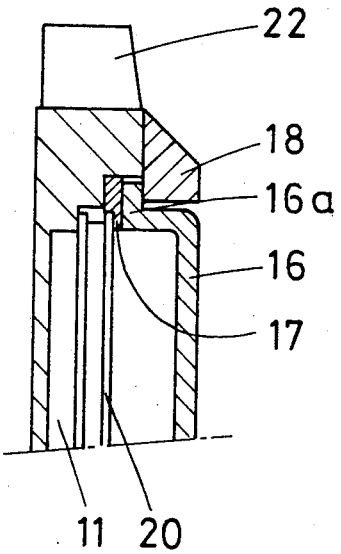
FIG. 8 shows a part section along the line VIII—VIII according to FIG. 7.
Figure 7:
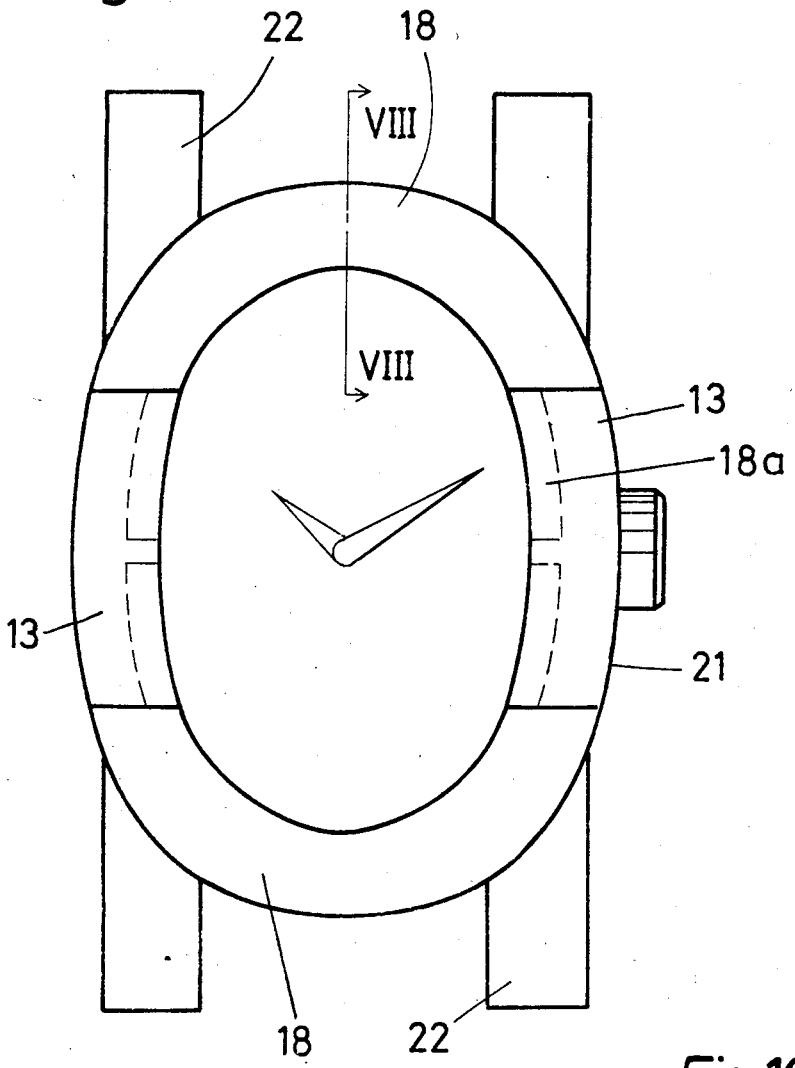
FIG. 7 shows a plan view of a third embodiment.
Figure 9:
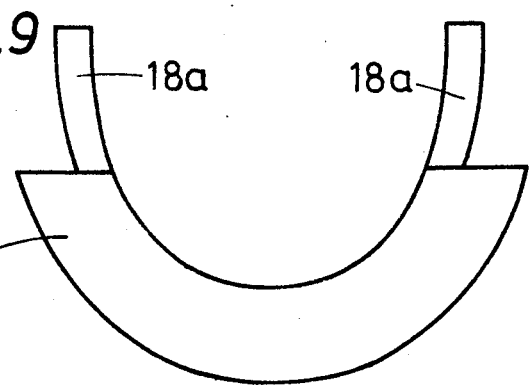
FIG. 9 shows a plan view of the clamping slide of the watch according to FIG. 7.
Figure 10:
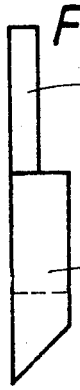
FIG. 10 shows a side view of this clamping slide.

According to FIGS. 1 to 3, the wrist-watch has a rectangular case 1 consisting of plastic, preferably in the form of an injection molding, in which the case band and the back are made in one piece. Formed on the upper edge of the rectangular case 1, on the longitudinal sides located opposite one another, are extensions 2 with flanges 3 projecting radially inwards, each limiting an inner case groove extending over the entire length of the respective case side. On the two flange-free case sides, which are the narrow sides provided with strap connections 12, the upper case edge 5 is located at the height of the inner case-wall portion forming the bottom of the groove 4.

In the example under consideration, the wrist-watch has a pot-shaped watch glass 6 with an edge 6*a* projecting radially outwards. Inserted between the underside of this watch-glass edge 6*a* and an inner shoulder 9 provided on the case 1 is a packing 7, the radially inner region of which is somewhat thinner than the remaining annular region and which overlaps the edge of the dial 10 located above the watch mechanism 11.

To close the case 1 and to press the watch glass 6 against the packing 7, there are two shackle-shaped clamping slides 8, 8*a* which, in the plan view according to FIG. 4, have approximately the form of an angular U and which possess two legs 8*a* formed on a base part 8. The dimensions of these clamping slides are selected so that by means of their legs 8*a* they can be pushed from the flange-free narrow sides of the case into the slits which are located between each of the flanges 3 and the watch-glass edge 6*a* and which include part of the case grooves 4. FIG. 2 illustrates the clamping slides 8, 8a, to be pushed in in the direction of the arrows, and their position, represented by unbroken lines, in the ready-assembled wrist-watch, the remaining parts of which are shown merely by dot-and-dash lines. The arrangement is such that, when the clamping slides have not yet been attached and the watch-glass 6 rests loosely on the packing 7, the distance between the underside of the flanges 3 and top side of the watch-glass edge 6a is so much less than the thickness of the legs 8a of the clamping slides that, when the latter are pushed in, the watch glass 6 is pressed correspondingly downwards, the packing 7 at the same time being compressed sufficiently. The legs 8a of the two clamping slides are each approximately half as long as a longitudinal side of the case, so that, in the assembled state, the said slits are filled practically completely by the legs 8a, and consequently the legs 8a press on the respective glass edges over their entire length.

As can be seen in the illustrations according to FIGS. 3 and 5, the base part 8 of each clamping slide is stepped on its underside, in such a way that the inwardly offset surface portion 8b facing the legs 8a lies in the same plane as the underside of the legs 8a and consequently, in a completely pushed-in state, engages over the watch-glass edge 6a on the flange-free case sides (FIG. 3), whilst the other surface portion 8c rests on the upper case edge 5. Furthermore, the thickness of the base part 8 is so much greater than the thickness of the legs 8a that, in the assembled state, the exposed top side of the base part 8 of each clamping slide lies in the same plane as the outside of the watch-glass 6. In the example under consideration, the ends 8d of the legs 8a are tapered in the form of a wedge, to make it easier to push in the clamping slide, and also the base part 8 has ends 8e which project somewhat beyond the outsides of the legs 8a laterally.

As illustrated in FIG. 2, in the example under consideration the flanges 3 do not project over the watch-glass edge 6a, so that, when the watch is assembled, the watch glass 6 can easily be introduced into the case 1 from the top side and set down on the packing 7. To complete the assembly operation, the two clamping slides are then merely pushed in the manner of drawers under the flanges 3 into the said slits, until the base part 8 of the clamping slides engages over the watch-glass edge 6a and rests against the side wall of the watch glass 6. The legs 8a of the clamping slides, on the one hand, and their base parts 8, on the other hand, then perform the function of a bezel retaining and pressing against the watch-glass. The legs 8a of the clamping slides are partially visible through the gap existing between the inner ends of the flanges 3 and the side wall of the watch-glass 6.

The clamping slides can be made of metal or plastic and contribute to the decorative exterior of the watch, and they can differ from the case 1 in appearance, that is to say particularly in terms of material and/or color.

The second exemplary embodiment illustrated in FIG. 6 has identical parts, bearing the same reference symbols, to those of the first exemplary embodiment according to FIGS. 1 to 5 and differs merely in that the flanges 3 of the case 1, which project radially inwards, overlap the watch-glass edge 6, so that the slits, which include the inner case grooves 4 and in which the legs 8a of the clamping slides are pushed, are practically closed. In this case, when the watch is assembled, the watch glass 6 is pushed in in the manner of a drawer on one flange-free narrow side of the case 1, the watch-glass edge 6a engaging under the flange 3. Subsequently, as in the first exemplary embodiment, the two clamping slides are then pushed in, the packing 7 at the same time being compressed.

The invention also relates to watches of which the edge limiting the orifice of the watch glass is curved, especially watches of oval shape. In this case, the clamping slides to be used have elastically flexible legs which preferably already have a curvature corresponding approximately to the bent edge form and which, when pushed in, match the curved slits between the flange and watch-glass edge. The base part of the clamping slides then also matches in shape the bent form of the flange-free case sides.

FIGS. 7 to 10 illustrate an exemplary embodiment of this type, in particular a wrist-watch with an oval case 21. The case 21 has flanges 13 projecting radially inwards on its slightly curved sides located opposite one another. The oval watch glass 16 is again pot-shaped and has an edge 16a which projects radially outwards and which rests on an inner case shoulder, with a packing 17 being interposed. The packing 17 overlaps the dial 20 arranged on the watch mechanism 11. The flanges 13 and the watch-glass edge 16a limit appropriately curved inner slits. The clamping slides 18, 18a consisting of an elastically flexible material have a base part 18, the bent shape of which matches the curvature of the case 21 on its sides possessing the strap connections 22, and slightly bent legs 18a, the form of which corresponds approximately to the curvature of the case sides having the flanges 13. When the clamping slides are pushed in, the legs 18a match the curve of the slits between the flanges 13 and the watch-glass edge 16a. At the same time, the watch glass 16 is pressed correspondingly downwards, the packing 17 being compressed. This again results in a reliable surface seal which guarantees the perfect tightness of the wrist-watch. The clamping-slide base parts 18, which rest on the upper watch-glass edge on the strap-connection sides and which have a bevel in the outer region in the example under consideration, again perform the function of bezel portions and, because of their decorative design, which can be any desired, also decisively determine the external appearance of the watch.

It is also possible, in principle, to provide only a single clamping slide, the legs of which are long enough to press against the watch-glass edge over a sufficiently long portion. The arrangement can also be such that the upper flanges of the case, which limit the said slits, extend along the strap-connection sides of the case, and the clamping slide or clamping slides are pushed in from one of the other case sides or from the other two case sides accordingly.

Although, in the assembled state, the clamping slides are generally gripped so strongly by the compressed packing that there is no need for any additional fastening, it is possible, if appropriate, to provide additional fixing. Thus, for example, the base parts 8 or 18 can be screwed firmly to the case 1 or locked in another way. It is also possible to fix the base parts or legs additionally by means of engagement or engagement elements.

What is claimed is:

1. A water-tight watch comprising:

a case having two opposed side walls with upper flanges oriented inwardly and inner shoulders disposed below said flanges at a preselected distance to define slits, and two end walls without slits;

a watch glass with two glass edges disposed in said slits;

a packing disposed in said slits above said shoulders; and clamping means including at least one clamping slide having two legs constructed and arranged to enter said slits as said clamping means is pushed from said walls toward a final position to press said watch glass edges against said packing.

2. The watch of claim 1 wherein said clamping means comprises two U-shaped clamping slides, each slide being pushed from one of said end walls, said legs having a total length substantially equal to the length of said side walls in said final position.

3. The watch of claim 1 wherein said clamping means comprises a U-shaped clamping slide with said two legs connected by a base, said slide being elastically flexible, and said case and watch glass have curved sides and edges respectively, whereby said clamping slides matches said case sides and watch glass edges as said slide is pushed into said slits.

4. The watch of claim 1 wherein said clamping means comprises a U-shaped clamping slide with said two legs connected by a base, said legs having coplanar leg bottom surfaces, and said base having a first base bottom surface coextensive with said leg bottom surfaces and a second base bottom surface, said first portion being constructed and arranged to partially overlap said watch glass in the final position and said second portion being constructed and arranged to overlap a corresponding end wall in said final position.

5. The watch of claim 1 wherein said watch is pot shaped and has a glass top surface, and said clamping means comprises a U-shaped clamping slide with said two legs connected by a base, said base having a base top surface coplanar with said glass top surface.

6. The watch of claim 1 wherein said upper flanges and said watch glass define gaps through which said clamping means is visible.

7. The watch of claim 1 wherein said flanges overlap said glass edges.

8. The watch of claim 1 wherein said clamping means comprises a U-shaped clamping slide with said two legs connected by a base, said legs having distal ends which are tapered to form wedges.

9. The watch of claim 1 wherein said clamping means comprises a U-shaped clamping slide with said two legs connected by a base, said base extending laterally beyond said legs.

10. The watch of claim 1 wherein said clamping means is affixed to said case in the final position.

11. The watch of claim 1 wherein said clamping means has a different color than said case.

12. The watch of claim 1 wherein said clamping means is made of a different material than said case.

13. The watch of claim 1 wherein said case is rectangular, and said end walls have strap connections.

14. The watch of claim 13 wherein said case is made of a plastic material.

15. The watch of claim 1 wherein said clamping means comprises two U-shaped clamping slides, said two legs of each slide connected by a base, said flanges and said bases having substantially coplanar top surfaces in the final position.

16. The watch of claim 15 wherein said legs have rectangular cross-sections.

17. The watch of claim 1 wherein said packing, glass edges and clamping means have an overall unrestricted thickness larger than the vertical dimension of said slit, whereby said packing is compacted in said final position.

* * * * *